United States Patent [19]

Conger, IV

[11] Patent Number: 4,978,281

[45] Date of Patent: Dec. 18, 1990

[54] VIBRATION DAMPENED BLOWER

[76] Inventor: William W. Conger, IV, 9552 Orange Ave., Anaheim, Calif. 92804

[21] Appl. No.: 234,377

[22] Filed: Aug. 19, 1988

[51] Int. Cl.[5] ..... F04B 39/00

[52] U.S. Cl. ..... 417/423.15; 417/423.14; 417/424.2; 29/530; 264/271.1; 264/273

[58] Field of Search ..... 417/423.15, 423.1, 424.1, 417/424.2, 423.2, 423.5, 423.14; 29/530; 264/271.1, 273, 274

[56] References Cited

U.S. PATENT DOCUMENTS

| | | | |
|---|---|---|---|
| 1,165,288 | 12/1915 | Rimmer . | |
| 2,036,058 | 3/1936 | Lang | 230/117 |
| 2,081,605 | 5/1937 | Sinclair | 188/218 R |
| 2,123,614 | 7/1938 | Sinclair | 29/530 |
| 2,129,199 | 9/1938 | Dake | 188/218 R |
| 2,228,750 | 1/1941 | Brock | 183/77 |
| 2,670,896 | 3/1954 | Ardito | 230/232 |
| 2,674,405 | 4/1954 | Cawl | 417/363 |
| 2,875,446 | 3/1959 | Nyberg | 15/325 |
| 3,031,129 | 4/1962 | Gaudry | 230/117 |
| 3,101,889 | 8/1963 | Tatge | 230/117 |
| 3,339,867 | 9/1967 | Bayless | 417/363 |
| 4,013,383 | 3/1977 | Rule | 417/366 |
| 4,120,616 | 10/1978 | Dwyer et al. | 417/373 |
| 4,221,547 | 9/1980 | Hoffman et al. | 417/363 |
| 4,597,131 | 7/1986 | Lyman | 15/412 |
| 4,735,555 | 4/1988 | Erickson, Jr. | 417/423.2 |
| 4,797,072 | 1/1989 | Berfield et al. | 417/423.2 |
| 4,830,807 | 5/1989 | Warren et al. | 264/235 |

*Primary Examiner*—Michael Koczo
*Assistant Examiner*—Eugene L. Szczecina, Jr.
*Attorney, Agent, or Firm*—Poms, Smith, Lande & Rose

[57] ABSTRACT

An air blower for a therapy pool has its motor blower assembly resiliently mounted to the housing for decreased transmission of noise and vibration to the case and attached plumbing. A resilient, elastomeric annulus, reinforced at its inner edge, connects the motor to the blower housing by means of an improved connection between the flexible annulus and the housing. The outer peripheral edge of the flexible annulus is formed with a pair of circumferential locking ribs and a number of circumferentially spaced holes, and this edge is permanently secured to the housing by being molded to and integrally embedded within a housing mounting ring that forms part of the blower housing.

4 Claims, 2 Drawing Sheets

VIBRATION DAMPENED BLOWER

BACKGROUND OF THE INVENTION

The present invention relates to air blowers for therapy pools, hot tubs, spas and the like, and more particularly concerns an improved, low noise, decreased vibration mounting for the motor blower assembly of the blower.

Air blowers for therapy pools, hot tubs, spas and the like are notoriously noisy. They move large volumes of air through constricted areas, and inherently require connection between the rotating motor and blower parts and rigid structures, such as plumbing connected to the blower casing. Noise and vibration of the blower are often greatly amplified by the connected plumbing and the structure. Sound installation material is often provided within the blower cover adjacent the air intake to help reduce the undesired noise. Some blower motors employ flexible mounting for the blower motor assembly. In such flexible mountings resilient elements interconnect the motor blower assembly and the system housing, requiring various complex structures and configurations for particular interconnections of rigid elements to flexible elements.

Interconnections between soft vibration motor mounting elements and the rigid system casing have been the subject of many different designs and much development. Generally a peripheral edge of the soft element is clamped or bolted between less resilient, stronger components of the case in attempts to securely mount the vibration damping elements to the system housing. These mountings are complex and costly, often requiring additional assembly steps and additional clamping parts and bolts. Where bolts go through the flexible element, the latter is significantly weakened, and strength, life and stability of the resulting connection are compromised.

Accordingly, it is an object of the present invention to provide an improved motor blower assembly mounting which avoids or minimizes above-mentioned problems.

SUMMARY OF THE INVENTION

In carrying out principles of the present invention in accordance with a preferred embodiment thereof, the system housing is provided with a fixedly connected rigid mounting ring, and a resilient motor mounting annulus has an inner peripheral end connected to the motor blower assembly. Means are provided for connecting the outer peripheral end portion of the resilient annulus to the mounting ring, including locking means on the outer peripheral portion of the annulus that are bonded to and within the rigid mounting ring.

In a particular embodiment the housing includes a mounting ring formed of a hard injection molded plastic, and a motor blower assembly is mounted to the ring by a soft elastomeric annulus, having an outer peripheral edge portion molded to and embedded within the mounting ring, thereby providing a bonded interconnection.

DETAILED DESCRIPTION

Figure 1:
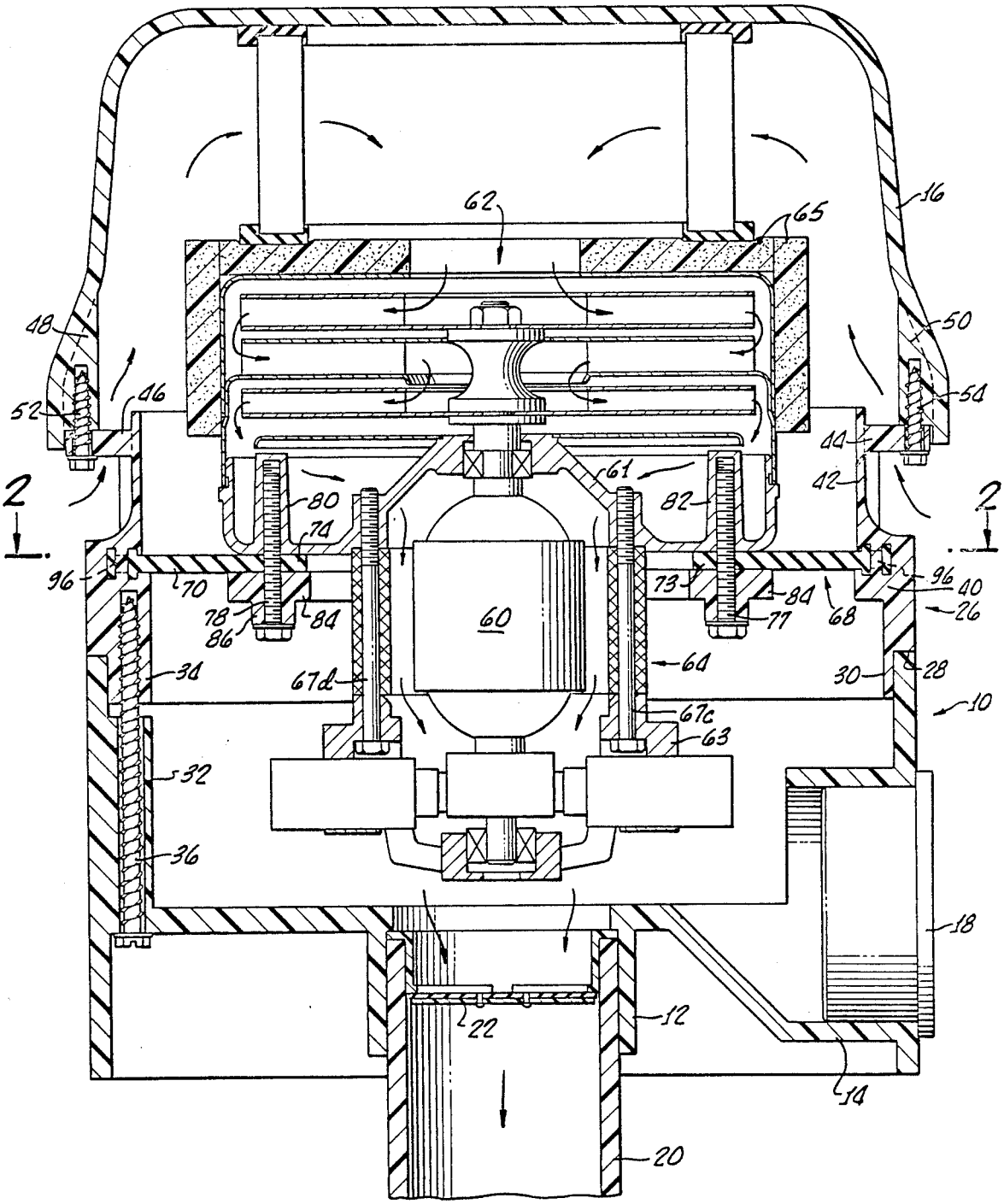
FIG. 1 is a vertical section through a blower incorporating principles of the present invention, taken on line 1—1 of FIG. 2.

Shown in FIG. 1 is an air blower constructed particularly for use with a therapy pool, hot tub, spa or the like. The blower includes a generally circular cylindrical lower housing section 10, having alternatively useful blower output fittings 12, 14 at a lower end and an intake cover 16 at an upper end. In the configuration illustrated, output fitting 14 is sealed by a removable plug 18, and air is to be blown through an output pipe 20 that is securely connected to output fitting 12 and incorporates a check valve 22. Commonly, the output pipe 20 not only provides for flow of air from the blower to the blower plumbing of the therapy pool, hot tub spa or the like, but also provides a fixed rigid support for the entire blower assembly. In such a situation, of course, the hollow pipe 20 is rigidly supported on some suitable structure (not shown).

Interposed between the lower housing section 10 and cover 16 is an intermediate mounting or housing ring 26, having a lower shoulder 28 that rests upon a top edge of the housing section 10, and a depending peripheral flange 30 that abuts the inner surface of the upper portion of the wall of housing section 10. A plurality of inwardly projecting bosses, such as bosses 32, 34, are integrally formed with the housing section 10 and mounting ring 26, respectively, for the reception of connecting screws 36 to rigidly secure the housing ring 26 to housing section 10. Preferably there are at least two (although only one is shown) of such sets of bosses and mounting screws spaced peripherally about the circular housing section 10 and mounting ring 26. The mounting ring 26 has a radially enlarged, thickened intermediate portion 40 that merges with a inner upstanding peripheral wall 42, having integrally formed circumferentially spaced connecting ears 44, 46 which extend radially outwardly. Cover 16 is formed with a plurality of downwardly extending bosses 48, 50, which receive screws 52, 54 extending through mounting ears 44, 46, respectively, into threaded engagement with the bosses 48, 50, thereby securely attaching the cover to the intermediate mounting ring 26.

A substantially conventional motor blower assembly includes a motor 60 and a two stage centrifugal blower 62. A motor frame 64 rotationally mounts the motor and the blower stages and is itself resiliently mounted to the intermediate mounting ring 26 by a flexible motor mounting assembly 68. The conventional motor assembly includes an upper frame portion 61, which carries the centrifugal blower 62, and a lower frame portion 63, which carries the motor 60 bolted together by bolts **67*a*, 67*b*, 67*c* and 67*d*. Sound absorption and insulation material, such as a conventional cellular plastic 65, is provided around portions of the centrifugal blower 62. Assembly 68 comprises a soft, resilient elastomeric annulus 70 formed of a material such as polystyrene. In a presently preferred embodiment the annulus 70 is a thermo-plastic rubber made by the Monsanto Company and sold under the trademark "SANOPRENE". The annulus 70 is bolted at its inner peripheral end to the motor mounting frame 64, and at its outer end is bonded to the intermediate mounting ring 26**, as will be described in detail below.

In operation of the described blower, air flows as indicated by the arrows (FIG. 1), being drawn in between the lower edge of the cover and the upstanding wall 42 of the intermediate mounting ring, flowing downwardly from the upper portion of the interior of the cover into and through the first and second stages of the blower blade assemblies, and thence through the motor frame, cooling the motor and exiting through the check valve 22.

Figure 2:
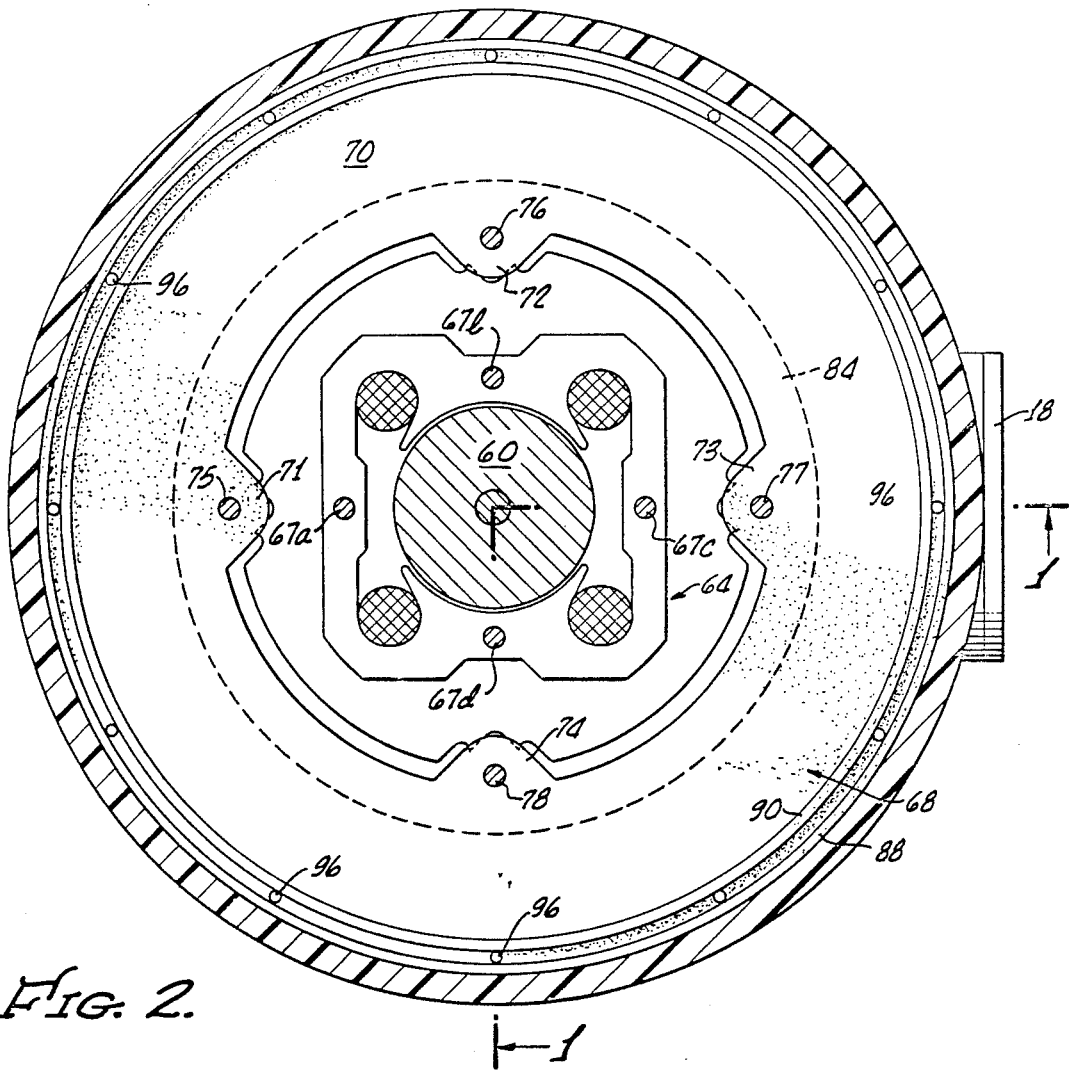
FIG. 2 is a section taken on line 2—2 of FIG. 1.

The inner peripheral end portion of the elastomeric annulus 70 is formed with a plurality of radially inwardly extending ears 71, 72, 73, 74 (FIG. 2), equally spaced around the annulus and apertured for reception of motor mounting securing bolts 75, 76, 77 and 78, which are threadedly received in lugs, such as lugs 80, 82 (FIG. 1) integrally formed in upper frame portion 61 of the motor mounting frame 64. A rigid plastic reinforcing ring 84 circumscribes the lower side of the inner peripheral edge of the elastomeric annulus 70 and is apertured for receipt of the bolts 75 through 78, which thus secure the ring 84, annulus 70 and motor frame 64 rigidly together. The ring 84 has a downwardly extending peripheral boss 86 which reinforces the area of the ring 84 around the bolt holes and provides greater rigidity for the interconnection between the motor frame 64 and the inner peripheral end portion of the elastomeric annulus 70.

Figure 4:
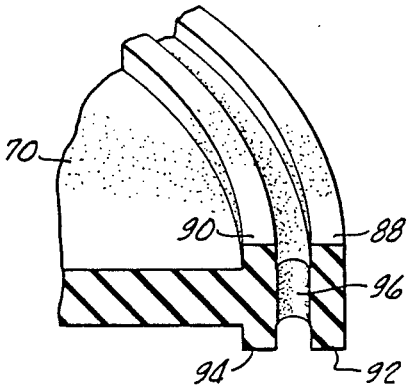
FIG. 4 is a fragmentary perspective view of a portion of the outer end of the motor mounting annulus.
Figure 3:
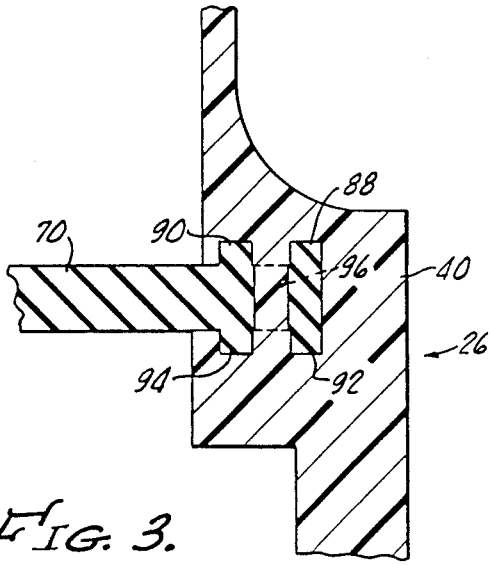
FIG. 3 is an enlarged fragmentary section through the bonded interconnection between the mounting ring and mounting annulus.

An unique and greatly improved interconnection is provided between the peripheral outer end portion of the elastomeric annulus 70 and the intermediate mounting ring 26. As best seen in FIGS. 3 and 4, the outer end portion of the elastomeric annulus is formed with a plurality of radially spaced, continuous circumferentially extending locking ribs 88, 90 projecting axially upwardly from the plane of the annulus on the upper side thereof, and corresponding radially spaced locking ribs 92, 94 circumferentially extending around the outer periphery of the annulus, and extending vertically downwardly away from the plane of the lower surface of the annulus. A plurality of locking apertures, such as apertures 96 (FIG. 2), extend through the body of the annulus 70 between the locking rib pairs 88, 90 and 92, 94, and are substantially equally spaced around the periphery of the annulus. In a presently preferred embodiment, where the intermediate mounting ring has a diameter of approximately 7½ inches, there are twelve apertures 96 spaced about the annulus periphery between the locking ribs thereof. The outer peripheral end portion and the locking elements, comprising ribs 88, 90, 92, 94 and locking holes 96 are bonded to and within the intermediate mounting ring 26, namely the enlarged portion 40 thereof. Thus the outer end portion and locking members of the resilient annulus are completely embedded within the body of ring 26. This is accomplished during molding of ring 26.

In manufacture of the motor mounting assembly, the elastomeric annulus and its outer locking ribs and holes are completely formed separately, and prior to molding of the ring 26. Then the outer end portion of this annulus 70 is positioned within a mold (not shown) in which the intermediate mounting ring 26 is to be formed, as by conventional injection molding techniques. The hard, rigid plastic material, an ABS plastic (such as that made and sold by Borg Warner as KJB), of the injection molded intermediate ring 40, is then injected into the mold so that the material flows at the high injection temperature and pressure throughout the mold, flowing completely around the end portion of the elastomeric annulus 70 (which is positioned within the mold), and also through the holes 96 thereof, completely filling the holes. The high temperature of the flowing ABS plastic effects some degree of surface melting of the end portion and locking elements of the elastomeric annulus that is positioned within the mold, and thus more firmly bonds the annulus and its locking elements to and within the enlarged portion 40 of the intermediate mounting ring. By this procedure the resilient annulus 70 has its outer end and its locking elements molded within the ring 26, and is, effectively, almost integral therewith. The terms "molded within" and equivalent terms employed herein denote the described arrangement wherein a pre-formed, separate part (annulus 70) is placed within the mold of a second part (ring 26) and the latter is then molded around the former.

It will be seen that the described connection between the elastomeric annulus and the rigid mounting ring provides a strong and permanent interconnection between the two, with the locking elements providing locking in radial, axial and circumferential directions. It may be noted that the flexible annulus is not molded to a large housing section, but is molded to and within the mounting ring, which forms but a small part of the entire housing. The molded bonding of the annulus to and within the mounting ring is more effectively performed when molding a relatively smaller portion of the housing than when molding the entire housing. Thus the ring 26 is separately formed as a small section of the housing 10, being effectively integral with the annulus 70, and is then fixedly attached to the housing and cover. Although other types of locking elements and locking configurations on the outer peripheral end portion of the elastomeric annulus 70 may be employed, it is important that the locking elements provide adequate surface area for bonding with the injection molded intermediate ring and also provide resistance to relative motion of the annulus in radial, axial and circumferential directions. The peripheral end portion of the annulus 70 may be formed without the described locking elements, to be simply inserted into the intermediate ring mold and then bonded to the intermediate ring as it is molded. However, the described locking elements are believed to significantly enhance the rigidity and efficiency of the bond.

The described arrangement resists motion of the motor and blower assembly relative to the case in various directions and dimensions. The assembly resists tilting and vertical vibration of the motor blower assembly relative to the case, absorbing and dampening motion and vibrations. Because the plumbing that is connected to the blower housing in the conventional therapy pool, hot tub or spa arrangement significantly amplifies noise and vibration of the blower housing, decrease of such noise and vibration results in startling decrease of blower noise. It has been found that sound generated by a blower constructed as described herein is decreased by 14 dB, decreasing from 78 to 64 dB (as measured at a point five feet from the blower), as compared with prior air blowers embodying substantially the same construction and components but not having the described flexible motor assembly mounting.

The foregoing detailed description is to be clearly understood as given by way of illustration and example only, the spirit and scope of this invention being limited solely by the appended claims.

What is claimed is:

1. An air blower for a therapy pool, hot tub or the like comprising in combination:

a blower support housing, a blower cover, a housing ring interposed between and fixedly connected to the cover and the housing, said ring having a molded body portion, a motor and fan assembly within the housing and blower cover, and motor mounting means for mounting the motor and fan assembly to the housing ring with decreased vibration, said mounting means comprising:

a flexible, resilient mounting annular having inner and outer peripheral edge portions, means for securing the motor and fan assembly to the inner peripheral edge portion of the annulus, said outer peripheral edge portion of the mounting annulus being integrally molded to and within the body portion of said housing ring, whereby the motor mounting annulus is securely and permanently mounted to the housing ring, said housing ring comprising an injection molded ring formed of a hard rigid plastic, said motor mounting annular including a radially outward peripheral portion having locking means extending therefrom, said annular being separately molded of a relatively soft, resilient plastic material, said annulus peripheral portion and said locking means being embedded within said housing ring body portion, said locking means comprising first and second radially spaced peripherally extending ribs projecting from the plane of said mounting annulus, said body portion of the housing ring being molded around and fully encompassing said outward peripheral portion of said annular and said locking means, and a plurality of peripherally spaced holes extending through said motor mounting annular between said ribs, said housing ring having integral portions thereof molded into and extending within said annular holes.

2. In the manufacture of an air blower for a therapy pool, spa or the like having a blower housing, a cover and a motor and fan mounted within the housing and cover, an improved method for mounting the motor and fan comprising the steps of:

forming a flexible, resilient motor mounting annulus of a relatively soft, resilient plastic material, forming a plurality of locking elements on an outer peripheral edge of the motor mounting annulus, positioning at least the outer peripheral edge and locking elements of the annulus in a housing ring mold, forming a housing ring by injection molding a hard plastic material into said mold, thereby molding the housing ring to and around said outer peripheral portion of the motor mounting annulus, interconnecting the housing ring together with the annulus molded thereto to and between the blower support housing and blower cover, and mounting the motor and fan to an inner peripheral portion of the motor mounting annulus, said step of forming the annulus comprising forming a plurality of upstanding circumferentially extending ribs on an outer peripheral portion of the annulus.

3. The method of claim 2 including the step of forming a plurality of holes in an outer peripheral portion of the motor mounting annulus, thereby causing material of the housing ring to flow into said holes during the molding of said housing ring.

4. In an air moving system having a blower housing and a blower motor mounted in the housing, improved resilient means for mounting the motor to the housing comprising:

a resilient motor mounting annular having an inner peripheral end connected to the motor, and having a radially outer peripheral end portion, said outer peripheral end portion of the annulus being embedded within and bonded to said housing, said outer peripheral end portion being molded to and within said housing to thereby provide a bonded interconnection between the housing and annulus, locking means on said outer peripheral end portion of the motor mounting annulus, said locking means and said outer peripheral end portion being embedded within and bonded to said housing, and a rigid housing ring connected to said housing, said end portion of the annulus and said locking means being molded within said rigid housing ring, said locking means comprising a first locking rib projecting from the plane of said annulus and extending substantially circumferentially around the edge of said annulus and a plurality of holes extending through said annulus, said plurality of holes being spaced around an outer peripheral portion of the annulus and being filled with integral portions of said molded housing ring.

* * * * *